US010137710B2

(12) United States Patent
Ichimiya et al.

(10) Patent No.: US 10,137,710 B2
(45) Date of Patent: Nov. 27, 2018

(54) PRINTER AND CONTROL METHOD

(71) Applicant: SEIKO EPSON CORPORATION, Tokyo (JP)

(72) Inventors: Yuta Ichimiya, Nagano (JP); Ryuji Moriyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/498,638

(22) Filed: Apr. 27, 2017

(65) Prior Publication Data

US 2017/0334222 A1 Nov. 23, 2017

(30) Foreign Application Priority Data

May 18, 2016 (JP) ..... 2016-099322

(51) Int. Cl.
*B41J 13/00* (2006.01)

(52) U.S. Cl.
CPC ..... *B41J 13/0009* (2013.01)

(58) Field of Classification Search
USPC ..... 347/9, 16; 399/18
See application file for complete search history.

(56) References Cited

U.S. PATENT DOCUMENTS

| | | | | |
|---|---|---|---|---|
| 4,530,494 A | | 7/1985 | Saitoh et al. | |
| 5,534,976 A | * | 7/1996 | Kim | B65H 43/04 399/18 |
| 2005/0201765 A1 | | 9/2005 | Shinga | |

FOREIGN PATENT DOCUMENTS

| | | | |
|---|---|---|---|
| JP | 58-183538 | A | 10/1983 |
| JP | 63-212632 | A | 9/1988 |
| JP | 2002-326432 | A | 11/2002 |
| JP | 2005-041229 | A | 2/2005 |
| JP | 2005-298209 | A | 10/2005 |
| JP | 2012-246096 | A | 12/2012 |
| JP | 2013-063553 | A | 4/2013 |
| JP | 2013-188900 | A | 9/2013 |
| JP | 2014-058400 | A | 4/2014 |
| JP | 2016-193770 | A | 11/2016 |

* cited by examiner

*Primary Examiner* — Lam Nguyen

(57) ABSTRACT

A printer which transports a sheet of paper from a paper tray inserted in the printer to perform printing includes: an insertion/removal sensing unit configured to sense insertion and removal of the paper tray; a transport failure sensing unit configured to sense a transport failure of the sheet of paper; and a print control unit configured to, if, when a transport failure is sensed by the transport failure sensing unit, the print control unit determines that transport of the sheet of paper is transport performed directly after the insertion/removal sensing unit sensed insertion of the paper tray, issue a notification for prompting a user to perform an operation relating to the paper tray.

10 Claims, 6 Drawing Sheets

PRINTER AND CONTROL METHOD

CROSS REFERENCES TO RELATED APPLICATIONS

The entire disclosure of Japanese Patent Application No. 2016-099322, filed May 18, 2016 is expressly incorporated by reference herein.

BACKGROUND

1. Technical Field

The present disclosure relates to printers which feed paper from paper trays, and more specifically, to a printer, or the like which enables accurate sensing of an error caused by a paper tray and correction of the error at an early stage.

2. Related Art

In a known printer of a paper tray system, an error, such as a so-called paper jam, has been determined based on a sensing result of a sensor disposed in a transport path of paper and/or on a carriage of a print head. When the occurrence of such an error is determined, in the known printer, an announcement is made to prompt a user to open a rear panel and/or an upper panel of the known printer so as to check for a paper jam, and the like.

Moreover, in the known printer, when the paper tray runs out of paper, a notification announcing that the paper tray runs out of paper is issued.

Note that JP-A-2013-63553 describes, as a related technique, an ink jet recording device which can maintain high accuracy of the position of an image recording range whether a tray is moved or not, wherein when it is detected that a paper feed tray is moved, a reset part resets the count value of the counter.

However, when paper is not appropriately loaded in the paper tray, or when a paper stack is disarranged when inserting the paper tray, a transport failure may occur, but notification of such an error caused by the paper tray is not issued traditionally.

This error cannot be confirmed even when the rear panel and/or the upper panel of the printer are/is opened, and the error may not be able to be readily corrected. Moreover, in this case, the printer is repeatedly operated, which may cause, for example, uneven wear of a roller.

Note that JP-A-2013-63553 fails to describe a means to solve these problems.

SUMMARY

An advantage of some aspects of the disclosure is that a printer, or the like which feeds paper from a paper tray and which enables accurate sensing of an error caused by the paper tray and correction of the error at an early stage is provided.

One aspect of the disclosure is a printer which transports a sheet of paper from a paper tray inserted in the printer to perform printing, the printer including: an insertion/removal sensing unit configured to sense insertion and removal of the paper tray; a transport failure sensing unit configured to sense a transport failure of the sheet of paper; and a print control unit configured to, if, when a transport failure is sensed by the transport failure sensing unit, the print control unit determines that transport of the sheet of paper is transport performed directly after the insertion/removal sensing unit sensed insertion of the paper tray, issue a notification for prompting a user to perform an operation relating to the paper tray.

According to the one aspect, an error relating to the paper tray can be accurately sensed, and a possibility of correction of the error at an early stage can be increased, which thereby eliminates a risk that the printer is repeatedly operated, and thus, for example, uneven wear of a roller occurs.

In the one aspect, the printer preferably further includes a transported sheet counter configured to count the number of sheets of paper transported after the insertion/removal sensing unit has sensed the insertion of the paper tray, wherein when a value of the transported sheet counter is zero, the print control unit determines that the transport of the sheet of paper is transport performed directly after the insertion/removal sensing unit sensed the insertion of the paper tray.

According to this configuration, the determination is made based on the value of the transported sheet counter. Therefore, it is possible to accurately determine whether or not printing (transport of a sheet of paper) is printing performed directly after the paper tray was inserted.

Moreover, in the one aspect, the transport failure is preferably sensed by determining absence of the sheet of paper in a transport path of the sheet of paper by the transport failure sensing unit.

According to this configuration, the transport failure is accurately determined.

Moreover, in the one aspect, the notification issued by the print control unit is preferably a notification for prompting a user to perform at least a removal/insertion operation of the paper tray or an operation of returning the sheet of paper stored in the paper tray to a storage position.

According to this configuration, a set error of the paper tray can be corrected accurately and at an early stage.

Another aspect of the disclosure is a method for controlling a printer which transports a sheet of paper from a paper tray inserted in the printer to perform printing, wherein an insertion/removal sensing unit configured to sense insertion and removal of the paper tray; and a transport failure sensing unit configured to sense a transport failure of the sheet of paper are provided, the method including issuing, if, when a transport failure is sensed by the transport failure sensing unit, it is determined that transport of the sheet of paper is transport performed directly after the insertion/removal sensing unit sensed insertion of the paper tray, a notification for prompting a user to perform an operation relating to the paper tray.

Further objects and features of the disclosure will become apparent from the embodiments of the disclosure described below.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Figure 1:
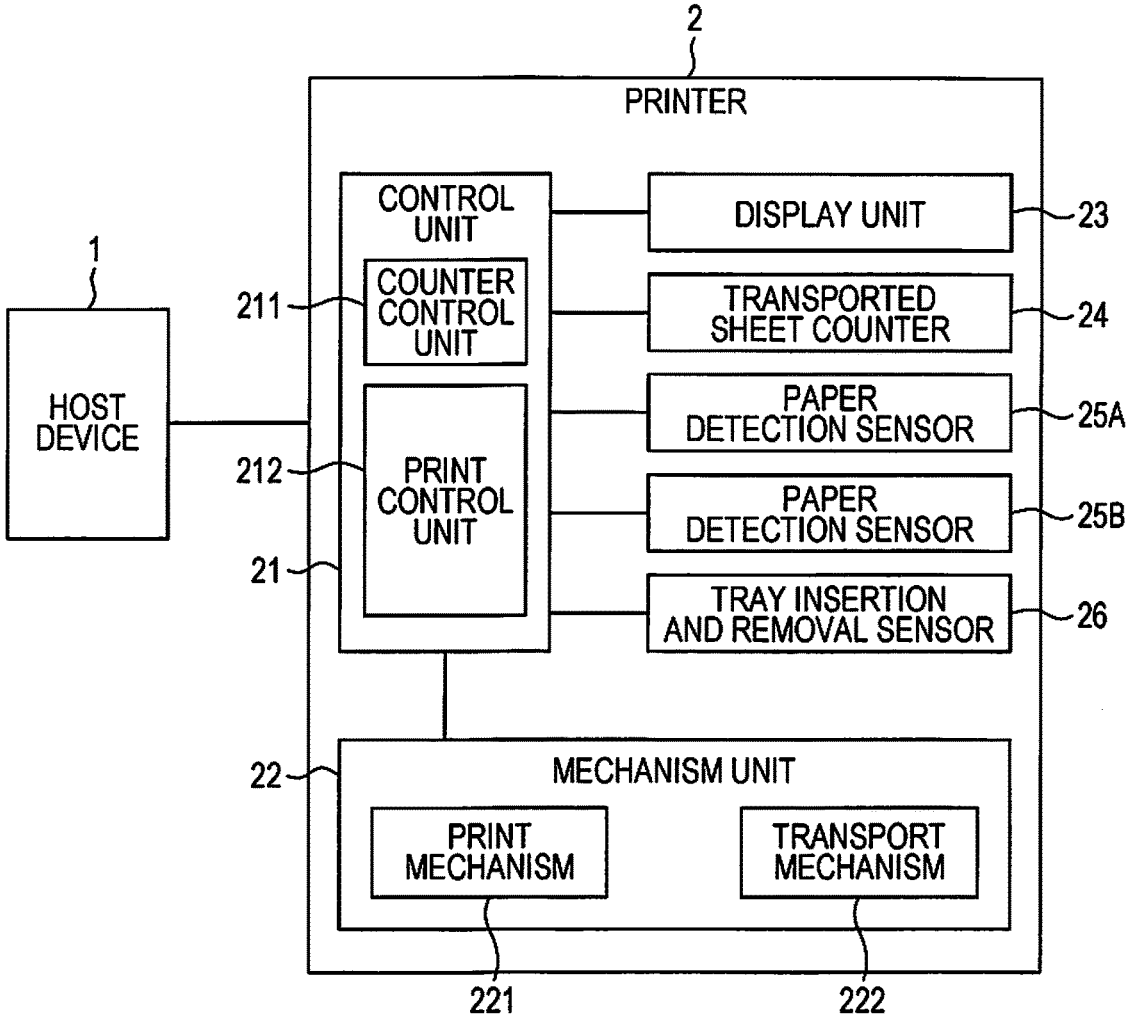
FIG. 1 is a view illustrating the configuration of a printer according to an embodiment to which the disclosure is applied.

Embodiments of the present disclosure will be described below with reference to the drawings. However, such embodiments do not restrict the technical scope of the disclosure. In the drawings, the same or similar components are denoted by the same reference numerals or symbols.

FIG. 1 is a view illustrating the configuration of a printer according to an embodiment to which the disclosure is applied. A printer 2 shown in FIG. 1 is a printer to which the disclosure is applied. The printer 2 feeds a sheet of paper 4 stored in a paper tray 3 to perform printing. If at the time of the printing, a transport failure of the sheet of paper 4 occurs, and the printing is printing performed for the first time after the paper tray 3 was inserted, the printer 2 determines that the transport failure can be an error having a connection with the paper tray 3, and the printer 2 issues a notification for prompting a user to perform a removal/insertion operation of the paper tray 3 and/or an operation of setting the sheet of paper 4 stored in the paper tray 3 in a correct position. Such control enables accurate sensing of an error caused by the paper tray 3 in the printer 2 and correction of the error at an early stage.

As described above, the printer 2 is, for example, an ink jet printer which performs printing on the sheet of paper 4 which is a cut sheet of paper stored in the paper tray 3. The printer 2 is installed in, for example, the back room of a convenience store and can be used to print out instruction contents and various types of information transmitted via a network from a head office.

A host device 1 shown in FIG. 1 is, for example, a host computer for issuing a print request to the printer 2. The host device 1 is connected to the printer 2 via a network or a cable so as to be able to communicate with the printer 2. In response to a print request, the host device 1 transmits print data to the printer 2.

As illustrated in FIG. 1, the printer 2 includes a control unit 21, a mechanism unit 22, a display unit 23, a transported sheet counter 24, paper detection sensors 25A and 25B, a tray insertion and removal sensor 26, and other components.

The control unit 21 is a unit that controls each of the components of the printer 2. Although not shown in the figure, the control unit 21 includes a CPU, RAM, ROM, an ASIC, NVRAM, and the like as hardware structures. As illustrated in FIG. 1, the control unit 21 includes a counter control unit 211 and a print control unit 212 as functional structures.

The counter control unit 211 is a unit that controls the value of the transported sheet counter 24. The counter control unit 211 increments the value (by one) each time a sheet of paper 4 is transported from the paper tray 3. When the paper tray 3 is pulled out of a tray accommodation part 222*a*, the counter control unit 211 resets the value (to 0).

The print control unit 212 is a unit that controls the operation of the mechanism unit 22 upon reception of a print request from, for example, the host device 1 to cause the printer 2 to transport a sheet of paper 4 from the paper tray 3 and to perform printing on the sheet of paper 4. When a transport failure occurs, the print control unit 212 also performs a process of issuing an error notification to a user.

The counter control unit 211 and the print control unit 212 each include a program which records process contents, a CPU for performing processing according to the program, RAM, and other components.

The mechanism unit 22 includes a transport mechanism 222 configured to transport the sheet of paper 4 and a print mechanism 221 configured to perform printing on the sheet of paper 4 which was transported.

The display unit 23 is a unit that displays information to a user. The display unit 23 may be configured as, for example, a liquid crystal display unit. When an error is sensed, information regarding the error is displayed on the display unit 23. In this way, a notification is issued to a user.

The transported sheet counter 24 is a component that counts (stores) the number of sheets of paper 4 transported from the paper tray 3. Specifically, the transported sheet counter 24 is a counter that counts the number of sheets of paper transported after the tray insertion and removal sensor 26 has sensed insertion of the paper tray 3.

The paper detection sensor 25A (transport failure sensing unit) and the paper detection sensor 25B are sensors that detect whether or not the sheet of paper 4 is present on a transport path 222*g*. For example, existing optical sensors can be used as the sensors 25A and 25B. Note that attachment positions of the paper detection sensors 25A and 25B will be described later. Based on determination results of the paper detection sensors 25A and 25B, the transport failure of the sheet of paper 4 is sensed.

The tray insertion and removal sensor 26 (insertion/removal sensing unit) is a sensor that detects insertion/removal of the paper tray 3 into/from the tray accommodation part 222*a*. When the paper tray 3 is pulled out of a body (the tray accommodation part 222), the tray insertion and removal sensor 26 can sense two states, i.e., a state in which the paper tray 3 inserted in the tray accommodation part 222 is started to be pulled out (a state in which the paper tray 3 is moved even a small distance (by several millimeters) from an inserted position, hereinafter referred to as a pulled-out state) and a state in which the paper tray 3 is completely pulled out from the body (the tray accommodation part 222). Note that as the tray insertion and removal sensor 26, an existing mechanical sensor, an existing contact type sensor, or the like can be used.

Figure 2:
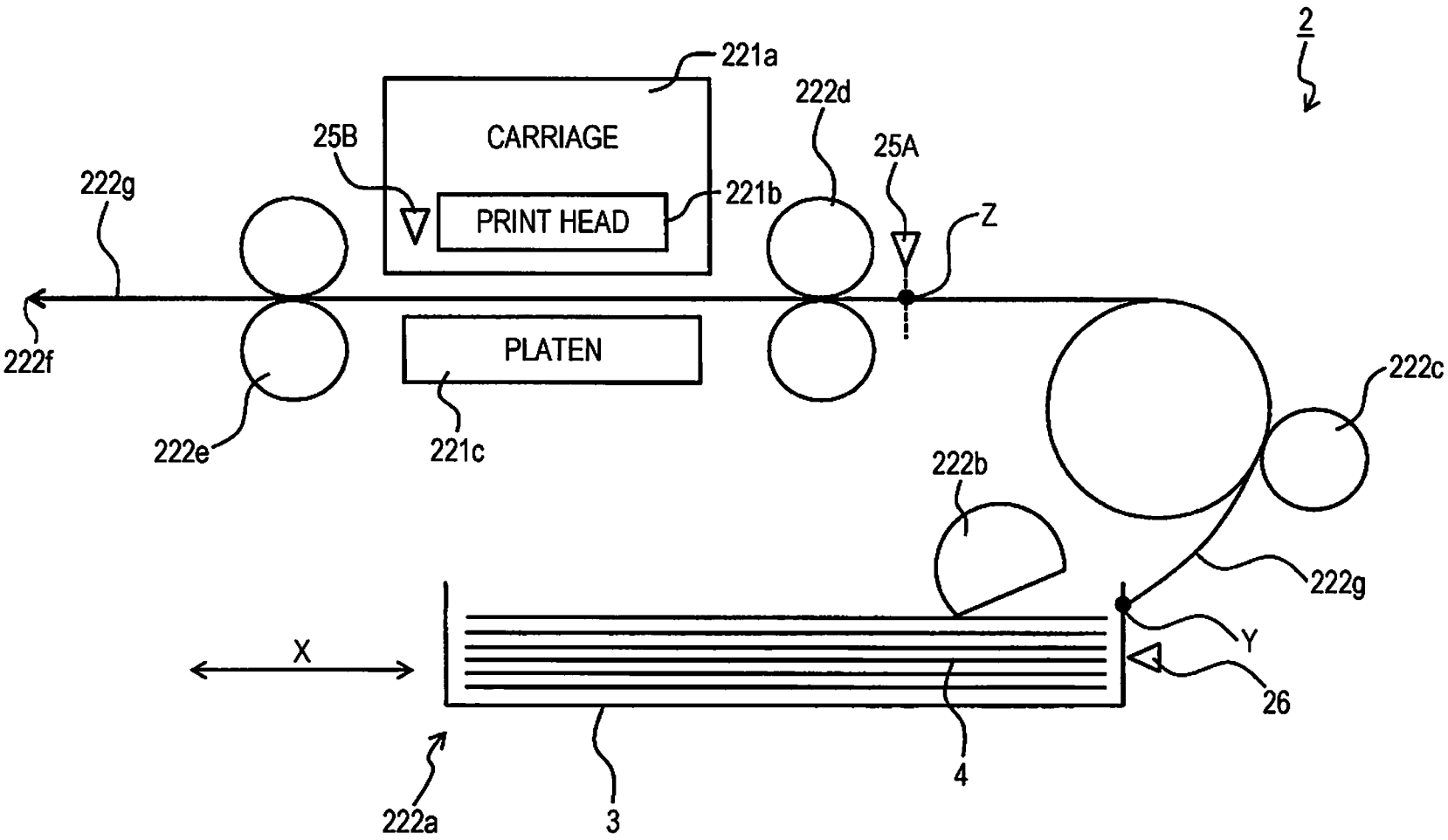
FIG. 2 is a side view schematically illustrating a mechanism of the printer.

FIG. 2 is a side view schematically illustrating a mechanism of the printer 2. FIG. 2 shows a state in which the paper tray 3 is inserted in the tray accommodation part 222*a*. The paper tray 3 is movable in directions indicated by an arrow X shown in FIG. 2. The paper tray 3 is moved in these directions, thereby being inserted into and removed from the tray accommodation part 222*a*. The movement of the paper tray 3 is sensed (detected) by the tray insertion and removal sensor 26 which is described above.

As illustrated in FIG. 2, sheets of paper 4 are loaded (stored) in the paper tray 3. When printing is performed, the sheets of paper 4 are fed to the transport path 222*g* by a pickup roller 222*b* one by one. Each sheet of paper 4 that is fed is moved by sheet transporting rollers 222*c*, and then, the sheet of paper 4 is transported to a print position by sheet feeding rollers 222*d*. As illustrated in FIG. 2, at the print position, a print head 221*b* and a platen 221*c* are disposed, and ink is ejected from a nozzle of the print head 221*b* to the sheet of paper 4 transported to the print position, thereby performing printing. Note that the print head 221*b* is mounted on a carriage 221*a* that moves in a sub-scan direction.

The sheet of paper 4, after the printing has been performed, is transported by sheet discharging rollers 222*e* to a discharge port 222*f* and is then discharged from the discharge port 222*f*.

Note that the tray accommodation part 222*a*, the pickup roller 222*b*, the sheet transporting rollers 222*c*, the sheet feeding rollers 222*d*, and the sheet discharging rollers 222*e* are included in the transport mechanism 222, and the carriage 221*a*, the print head 221*b*, and the platen 221*c* are included in the print mechanism 221.

As illustrated in FIG. 2, the paper detection sensor 25A is disposed so as to detect the sheet of paper 4 at a position in front of the sheet feeding rollers 222*d* in the transport path 222*g* (a position located slightly upstream of the sheet feeding rollers 222*d*), and the paper detection sensor 25B is disposed on the carriage 221*a* and is arranged to detect the sheet of paper 4 at a position in the vicinity of the print head 221*b* in the transport path 222*g*.

In FIG. 2, an area from a Y point to a Z point in the transport path 222*g* is referred to as an A area, and an area located downstream of the Z point is referred to as a B area.

When the sheet of paper 4 which is supposed to be detected by the paper detection sensor 25A is not detected, a failure such as a paper jam in the A area or a failure relating to the paper tray 3 is suspected. When the sheet of paper 4 is transported to the paper detection sensor 25A without failure, but the sheet of paper 4 which is supposed to be detected by the paper detection sensor 25B is not detected, a failure in the B area is suspected.

The printer 2 having a configuration as described above has features of error detection and an error notification during print processing. The error detection and the error notification will be specifically described below. In particular, the printer 2 has features of detecting an error regarding the paper tray 3 and providing notification of the error.

Figure 3:
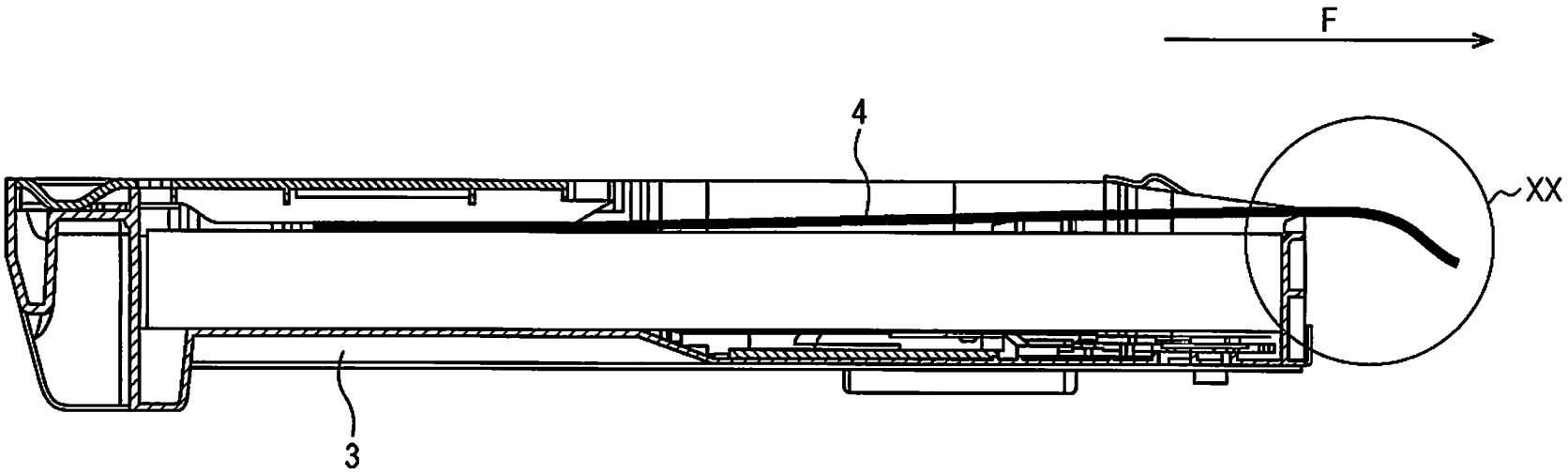
FIG. 3 is a view illustrating a state in which an error relating to a paper tray occurs.
Figure 4:
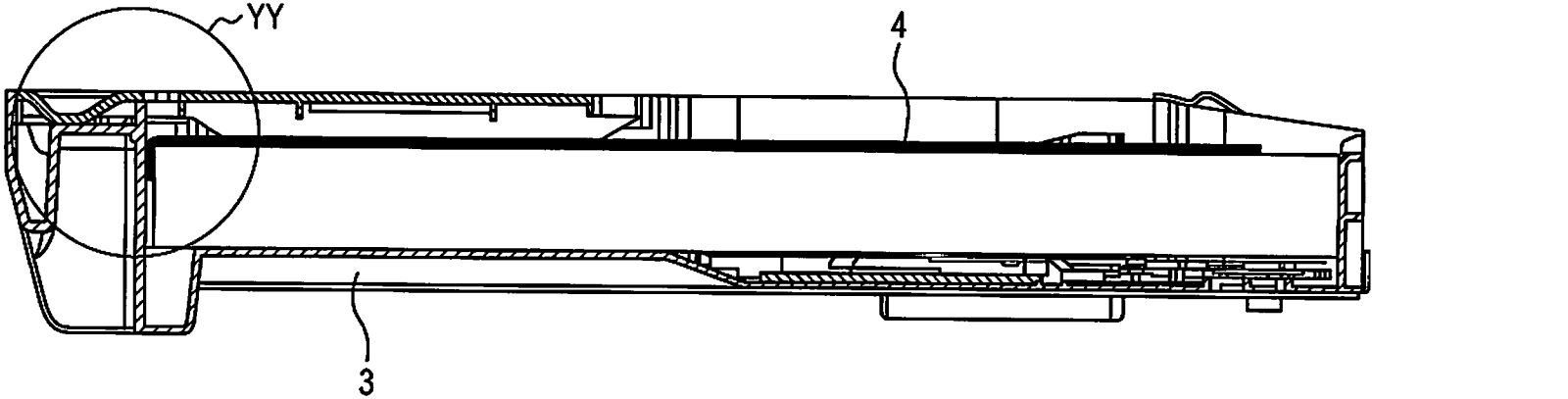
FIG. 4 is a view illustrating a state in which an error relating to the paper tray occurs.

FIGS. 3 and 4 are each a view illustrating a state in which an error relating to the paper tray 3 occurs. In FIGS. 3 and 4, an arrow F indicates a transport direction of the sheet of paper 4. In a state shown in FIG. 3, the sheet of paper 4 lies beyond the paper tray 3 in the direction indicated by the arrow F (see XX in FIG. 3). In a state shown in FIG. 4, an end of the sheet of paper 4 in a direction indicated by the arrow F is pinched between the paper tray 3 and other sheets of paper 4 (see YY in FIG. 4). In the states shown in both of the figures, the sheet of paper 4 cannot be appropriately transported (cannot be delivered).

Next, a count process of the transported sheet counter 24 used in sensing (determining) an error relating to the paper tray 3 will be described.

Figure 5:
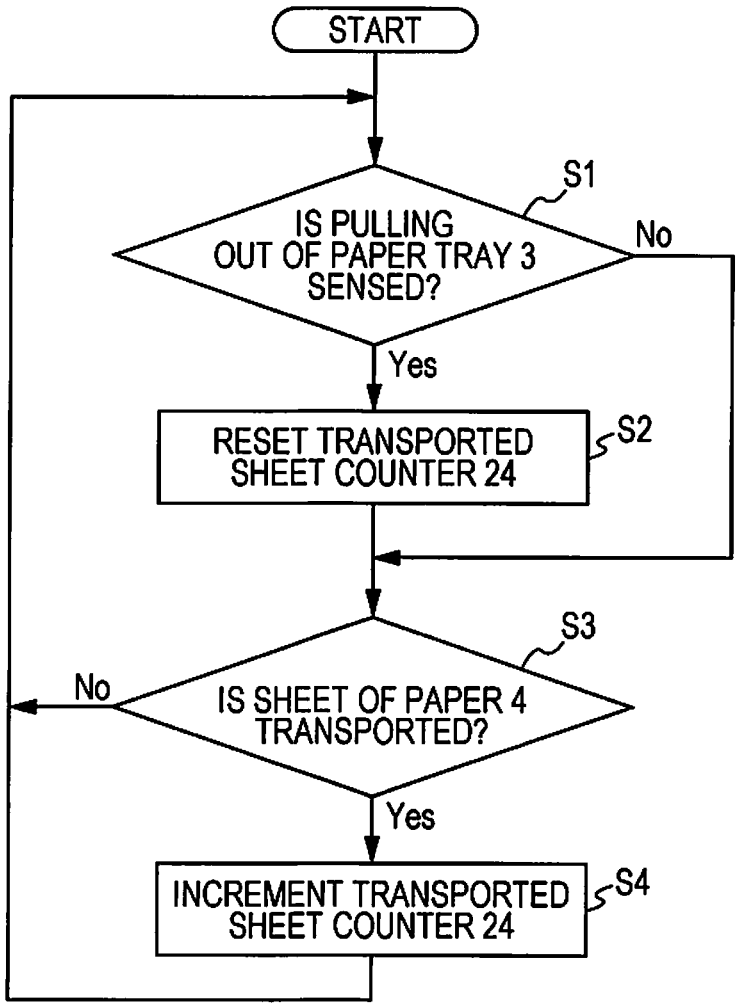
FIG. 5 is a flowchart illustrating a procedure of processes of a counter control unit.

FIG. 5 is a flowchart illustrating a procedure of processes of the counter control unit 211. The counter control unit 211 constantly checks whether or not pulling out of the paper tray 3 is sensed by the tray insertion and removal sensor 26 (step S1 of FIG. 5), and if the pulling out of the paper tray 3 is sensed (if Yes is determined in step S1 of FIG. 5), the counter control unit 211 resets the transported sheet counter 24 so that the value of the transported sheet counter 24 is set to 0 (step S2 of FIG. 5).

If the pulling out of the paper tray 3 is not sensed (if No is determined in step S1 of FIG. 5), the procedure proceeds to step S3.

In step S3, the counter control unit 211 checks whether or not the sheet of paper 4 is transported. Specifically, for example, when the determination result of the paper detection sensor 25A changes from presence of paper to absence of paper, the counter control unit 211 determines that one sheet of paper 4 is transported.

Then, if the sheet of paper 4 is transported (if Yes is determined in step S3 of FIG. 5), the counter control unit 211 increments the value (count value) of the transported sheet counter 24 (by one) (step S4 of FIG. 5). Then, the procedure returns to step S1.

If the sheet of paper 4 is not transported (if No is determined in step S3 of FIG. 5), the procedure returns to step S1.

In this way, the counter control unit 211 increments the value of the transported sheet counter 24 each time the sheet of paper 4 is transported, and when the paper tray 3 is pulled out, the counter control unit 211 resets the value of the transported sheet counter 24 to 0.

Figure 6:
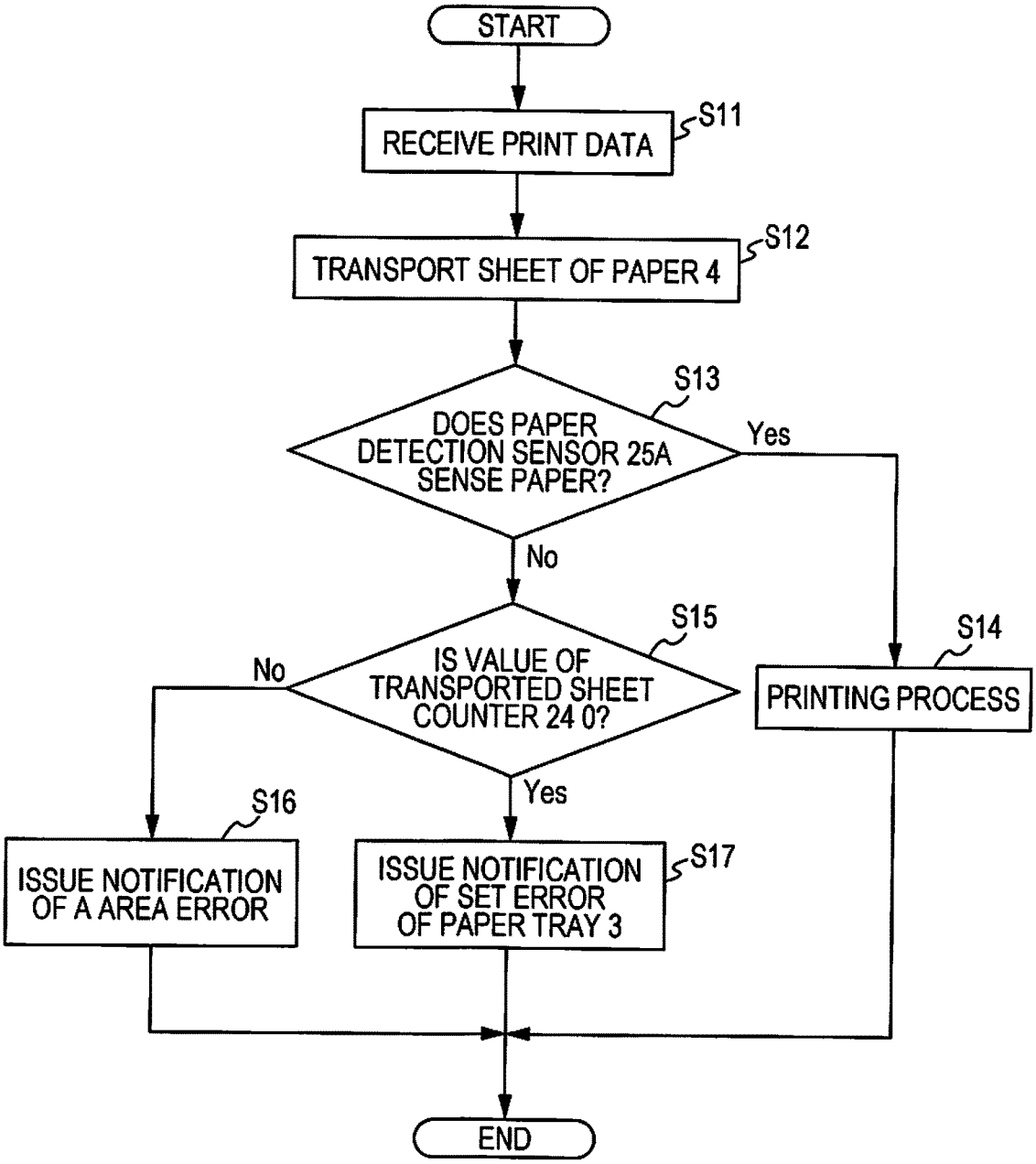
FIG. 6 is a flowchart illustrating a procedure of processes performed by a print control unit.

Next, processes in performing printing, in particular, error sensing and an error notification in performing the printing will be described. FIG. 6 is a flowchart illustrating a procedure of processes performed by the print control unit 212. Here, a process of one sheet of paper 4 will be described.

First, the print control unit 212 receives print data from, for example, the host device 1 (step S11 of FIG. 6).

Next, the print control unit 212 causes the printer 2 to perform a process of transporting the sheet of paper 4 stored in the paper tray 3 to a print position (step S12 of FIG. 6). Specifically, the print control unit 212 controls the transport mechanism 222 so as to pick up the sheet of paper 4 from the paper tray 3 and transport the sheet of paper 4 until a top edge of the sheet of paper 4 comes to a predetermined position (cueing position) downstream of the sheet feeding rollers 222*d*.

Then, the print control unit 212 checks during the transport, whether or not the paper detection sensor 25A senses (detects) the sheet of paper 4 which is supposed to be transported (step S13 of FIG. 6). As a result of the check, if the paper detection sensor 25A senses (detects) the sheet of paper 4 (if Yes is determined in step S13 of FIG. 6), the print control unit 212 determines that the sheet of paper 4 is appropriately transported and causes the printer 2 to perform a normal printing process (step S14 of FIG. 6). In the normal printing process, the print control unit 212 causes the printer 2 to transport the sheet of paper 4 to the print position as described above, to perform printing by the print head 221*b*, and then, to discharge the sheet of paper from the discharge port 222*f*. Note that during this process, if a failure (error) occurs in which the paper detection sensor 25B does not sense (detect) the sheet of paper 4, the print control unit 212 determines the occurrence of the failure in the B area and issues to a user a notification of the occurrence of the error and a method for correcting the error, and the like. Specifically, the print control unit 212 displays on the display unit 23, a notification that, for example, a paper jam has occurred in the B area and that a user should open the upper panel (the upper panel of the printer 2 which is installed) to remove the sheet of paper 4. When this process in step S14 is completed, the processing of the one sheet of paper 4 is terminated.

However, in step S13, as a result of the check, if the paper detection sensor 25A does not sense (detect) the sheet of paper 4 (if No is determined in step S13 of FIG. 6), the print control unit 212 determines that the sheet of paper 4 has not been transported appropriately (a transport failure), that is, that any error has occurred, and the print control unit 212 performs a process of locating a position (area) where the error has occurred. Specifically, the print control unit 212 checks whether or not the value of the transported sheet counter 24 is 0 (step S15 of FIG. 6).

As a result of the check, if the value of the transported sheet counter 24 is not 0 (if No is determined in step S15 of FIG. 6), the print control unit 212 determines that printing (transport of the sheet of paper 4) is not printing performed directly after the paper tray 3 was inserted, and the print control unit 212 determines that the error has occurred in the A area. This is because since the printing is not printing performed directly after the paper tray 3 was inserted, and several sheets of paper 4 have thus already been appropriately transported, the error is unlikely an error relating to the paper tray 3. Then, the print control unit 212 issues to a user a notification of an A area error (step S16 of FIG. 6). Specifically, for example, the print control unit 212 displays on the display unit 23, an announcement that an error such as a paper jam in the A area has occurred and that the rear panel (the rear panel of the printer 2 in an installed state, on the right side in FIG. 2) should be opened to remove the sheet of paper 4. The processing of the one sheet of paper 4 is terminated with the process in step S16.

However, as a result of the check, if the value of the transported sheet counter 24 is 0 (if Yes is determined in step S15 of FIG. 6), the print control unit 212 determines that printing (transport of the sheet of paper 4) is printing performed directly after the paper tray 3 was inserted (directly after the tray insertion and removal sensor 26 sensed the insertion of the paper tray 3), and the print control unit 212 determines that an error relating to the paper tray 3 (a set error of the paper tray 3) is suspected. Then, the print control unit 212 issues to a user a notification of the set error of the paper tray 3 (step S17 of FIG. 6).

Specifically, for example, the print control unit 212 issues a notification that the error has occurred around the paper tray 3, and the print control unit 212 displays an announcement on the display unit 23 to prompt a user to perform an operation relating to the paper tray 3. The operation relating to the paper tray 3 includes a removal/insertion operation of the paper tray 3, and/or an operation of returning the sheet of paper 4 stored in the paper tray 3 to a correct storage position. The processing of the one sheet of paper 4 is terminated with the process in step S17.

Note that even when the occurrence of an error is directly after the insertion of the paper tray 3, the error may have no connection with the paper tray 3 and may be the A area error. Therefore, if the error is not corrected by the above-described operation relating to the paper tray 3 performed after the notification of the set error of the paper tray 3, a notification of the A area error may be issued in the same manner as in step S16.

In the above-described example, the notification of the error is displayed on the display unit 23. However, the notification of the error may be provided by voice from a voice generation unit (not shown) included in the printer 2, transmission of notification information to the host device 1, or the like. Alternatively, the notification of the error may be performed by a combination of these methods.

Note that whether or not the set error of the paper tray 3 occurs largely depends on how a user handles the paper tray 3. Therefore, for a user whose handling of the paper tray 3 causes a relatively few set errors, the process relating to the set error of the paper tray 3 may be omitted. That is, in the process based on FIG. 6, if No is determined in step S13, the procedure proceeds to step S16 in all cases.

As described above, in the printer 2 according to the present embodiment, the transported sheet counter 24 is reset when the paper tray 3 is pulled out so as to determine, based on the value of the transported sheet counter 24, whether or not printing (transport of the sheet of paper 4) is printing performed directly after the paper tray 3 was inserted, and if, when the occurrence of a transport failure is determined based on the detection result of the paper detection sensor 25A, it is determined that the printing (transport of the sheet of paper 4) is printing performed directly after the paper tray 3 was inserted, the transport failure can be a set error of the paper tray 3, and thus, a notification of the set error is issued. Therefore, the set error of the paper tray 3, notification of which is not issued traditionally, can be accurately sensed. Moreover, since the notification of the set error of the paper tray 3 is issued, the error is highly possibly corrected at an early stage, which also eliminates a risk that the printer is repeatedly operated, and thus, for example, uneven wear of a roller occurs.

As described above, since the determination is made based on the value of the transported sheet counter 24, it is possible to accurately determine whether or not printing (transport of sheet of paper 4) is printing performed directly after the paper tray 3 was inserted.

Moreover, the transport failure is accurately determined based on the detection result of the paper detection sensor 25A.

Moreover, a notification of a set error of the paper tray 3 includes information for prompting a user to perform, for example, an operation relating to the paper tray 3, specifically, a removal/insertion operation of the paper tray 3 and/or an operation of returning the sheet of paper 4 stored in the paper tray 3 to a correct storage position, and therefore, the set error of the paper tray 3 can be corrected accurately and at an early stage.

Note that in the present embodiment, the printer 2 is an ink jet system printer, but the disclosure is applicable to printers in other print systems.

The extent of protection of the disclosure is not limited to the above-described embodiments but extends to the disclosure in the claims and equivalent thereof.

What is claimed is:

1. A printer which transports a sheet of paper from a paper tray inserted in the printer to perform printing, the printer comprising:

an insertion/removal sensing unit configured to sense insertion and removal of the paper tray;

a transport failure sensing unit configured to sense a transport failure of the sheet of paper; and a print control unit configured to, in response to the transport failure sensing unit sensing the transport failure during a current transport of the sheet of paper, determine whether the current transport of the sheet of paper is a first transport that is performed directly after the insertion/removal sensing unit sensing the insertion of the paper tray, the print control unit being further configured to, in response to determining that the current transport of the sheet of paper is the first transport, issue a notification for prompting a user to perform an operation relating to the paper tray.

2. The printer according to claim 1, wherein the transport failure is sensed by determining absence of the sheet of paper in a transport path of the sheet of paper by the transport failure sensing unit.

3. The printer according to claim 1, wherein the notification issued by the print control unit is a notification for prompting a user to perform at least a removal/insertion operation of the paper tray or an operation of returning the sheet of paper stored in the paper tray to a storage position.

4. The printer according to claim 1, wherein the print control unit issues, among notifications for prompting a user to perform operations relating to a plurality of positions where the transport failure possibly occurs, a notification for prompting the user to perform an operation relating to the paper tray in preference to the notifications for promoting the operations relating to the plurality of positions other than the paper tray.

5. A printer which transports a sheet of paper from a paper tray inserted in the printer to perform printing, the printer comprising:

an insertion/removal sensing unit configured to sense insertion and removal of the paper tray;

a transport failure sensing unit configured to sense a transport failure of the sheet of paper;

a print control unit configured to, when the transport failure sensing unit senses the transport failure during transport of the sheet of paper performed directly after the insertion/removal sensing unit sensed insertion of the paper tray, issue a notification for prompting a user to perform an operation relating to the paper tray; and a transported sheet counter configured to count the number of sheets of paper transported after the insertion/removal sensing unit has sensed the insertion of the paper tray, wherein when a value of the transported sheet counter is zero, the print control unit determines that the transport of the sheet of paper is transport performed directly after the insertion of the paper tray was sensed.

6. A method for controlling a printer which transports a sheet of paper from a paper tray inserted in the printer to perform printing, the method comprising:

determining, in response to sensing a transport failure during a current transport of the sheet of paper, whether the current transport of the sheet of paper is a first transport that is performed directly after sensing insertion of the paper tray; and issuing, in response to determining that the current transport of the sheet of paper is the first transport, a notification for prompting a user to perform an operation relating to the paper tray.

7. The method according to claim 6, wherein the transport failure is sensed by determining absence of the sheet of paper in a transport path of the sheet of paper.

8. The method according to claim 6, wherein the notification is a notification for prompting a user to perform at least a removal/insertion operation of the paper tray or an operation of returning the sheet of paper stored in the paper tray to a storage position.

9. The method according to claim 6, wherein among notifications for prompting a user to perform operations relating to a plurality of positions where the transport failure possibly occurs, a notification for prompting the user to perform an operation relating to the paper tray is issued in preference to the notifications for promoting the operations relating to the plurality of positions other than the paper tray.

10. A method for controlling a printer which transports a sheet of paper from a paper tray inserted in the printer to perform printing, the method comprising:

issuing, when a transport failure is sensed during transport of the sheet of paper performed directly after insertion of the paper tray was sensed, a notification for prompting a user to perform an operation relating to the paper tray, wherein when the number of sheets of paper transported after the insertion of the paper tray has been sensed is zero, it is determined that the transport of the sheet of paper is transport performed directly after the insertion of the paper tray was sensed.

* * * * *